US005270676A

United States Patent [19]

Mitobe et al.

[11] Patent Number: 5,270,676

[45] Date of Patent: Dec. 14, 1993

[54] METHOD OF MAKING ELEMENTS OF A MAGNETIC CIRCUIT IN A LOUDSPEAKER

[75] Inventors: Kunio Mitobe; Shuichi Watanabe; Masatoshi Sato, all of Yamagata, Japan

[73] Assignee: Pioneer Electronic Corporation, Tokyo, Japan

[21] Appl. No.: 811,333

[22] Filed: Dec. 20, 1991

[30] Foreign Application Priority Data

May 30, 1991 [JP] Japan ..... 3-155777

[51] Int. Cl.[5] ..... H01F 7/00; H01F 7/08

[52] U.S. Cl. ..... 335/231; 335/222; 335/281; 72/267

[58] Field of Search ..... 335/231, 222, 281, 297; 72/267; 381/189, 199, 201

[56] References Cited

U.S. PATENT DOCUMENTS 2,965,228 12/1960 Scribner ..... 72/267
3,460,080 8/1969 Carbonaro ..... 335/231
3,861,191 1/1975 Sato et al. ..... 72/267
3,953,687 4/1976 Carbonneau ..... 335/222

FOREIGN PATENT DOCUMENTS 46-8272 3/1971 Japan .
2-280773 10/1990 Japan .

*Primary Examiner*—Harold Broome
*Attorney, Agent, or Firm*—Nikaido, Marmelstein, Murray & Oram

[57] ABSTRACT

A lower die having a first recess corresponding to one of outer shapes of the element, and an upper die having a second recess are provided. The outer diameter of the upper dies is smaller than the inner diameter of the first recess so that a gap is formed between the inside wall of the first recess and the outside wall of the upper die. A workpiece is put between the lower and upper dies, and the upper die is pressed against the lower die to form the element.

2 Claims, 3 Drawing Sheets

METHOD OF MAKING ELEMENTS OF A MAGNETIC CIRCUIT IN A LOUDSPEAKER

BACKGROUND OF THE INVENTION

The present invention relates to a method of making elements of a magnetic circuit in a loudspeaker such as yoke and plate.

In an electrodynamic loudspeaker, which is widely used, an electric signal is converted into an acoustic signal by magnetic flux generated by a magnet and magnetic force caused by the electric signal.

Referring to FIG. 2 a cone loudspeaker, which is one type of electrodynamic loudspeaker, has a yoke 12 having an integral center pole 11 and a yoke base 13, an annular magnet 14 mounted on the yoke base 13, and an annular plate 15 mounted on the magnet 14, thereby forming a magnetic circuit. On the plate 15 is mounted a conical frame 20 which supports a conical diaphragm 23 around an upper edge thereof at an edge 21. A lower edge of the diaphragm 23 is disposed in a magnetic gap G formed between the center pole 11 of the yoke 12 and the plate 15 and secured to a voice coil 22 which is supported by a damper 24. A lead 30 connects the voice coil 22 to an external terminal 31 which is connected to an external source to feed audio current to the voice coil 22. When applied with the audio current, the voice coil 22 generates a magnetic force, which moves the voice coil 22. The diaphragm 23 is thus caused to vibrate to produce sound waves.

In the speaker, the base 13 has a uniform thickness as shown in FIG. 2. In such a speaker there is a large leakage flux, which causes the magnetic flux generated in the magnetic gap G to reduce. Japanese Utility Model Publication 46-8272 discloses a yoke where the thickness of which is reduced toward the peripheral portion thereof to prevent the reduction of the magnetic flux.

The inventors of the present invention have proposed a magnetic circuit in Japanese Patent Application 2-280773 which is shown in FIG. 3. A yoke 12*a* and plate 15*a* are slanted toward the periphery. The upper surface of the plate 15*a* has a slight curve 17 and the lower surface of a yoke base 13*a* has also a curve 16 so that each of the peripheral portion thereof is extremely thinned. A loudspeaker having such an arrangement is advantageous in that the magnetic flux flows mainly through the gap G so that a leakage flux $\phi 1$ between the plate 15*a* and the yoke base 13*a*, detouring the magnet 14, is decreased. A leakage flux $\phi 2$ which flows from the plate 15*a* to the center pole 11 is also decreased.

Such a yoke and a plate are manufactured by cold forging so as to form thin peripheral edges.

Referring to FIG. 4*a*, a roughly shaped workpiece W is disposed between an upper die 40 and a lower die 42, which together form an inner space for a desired shape of the yoke base 13*a*. The upper die 40 has a recess 41 having a curve which corresponds to the curve 16 of the yoke base 13*a*, and the lower die 42 has a recess 43 which corresponds to the contour of the center pole 11. When the upper die 40 is pressed against the lower die 42 at a pressure P, the workpiece W is shaped in accordance-with the inner shape of the dies 40 and 42 by plastic flow. Hence the yoke 12*a* having the appropriate curve 16 along the lower surface of the base 13*a* is obtained. The plate 15*a* having the curve 17 is manufactured in the same manner.

During the process, a part of the workpiece W extends in a small gap g formed between the upper and lower dies 40 and 42 to form a thin peripheral portion of the yoke base 13*a*. However, the quantity of the material entering the gap g is liable to differ in different peripheral places. As a result, as shown by dotted lines in FIG. 4*b*, the periphery of the yoke 12*a* has not a round shape so that the yokes having various dimensions are produced, which causes reduction of dimensional accuracy. The accuracy is further decreased as the peripheral portion becomes thinner.

If a smaller diameter d1 than a desired diameter d2 shown in FIG. 4*b* is used, the magnet 14 largely extends from the periphery of the yoke base 13*a*. On the other hand, if the yoke base 13*a* has a large diameter d3, the magnet 14 is positioned far inside the periphery of the yoke 12*a*. These inaccuracies cause the increase of leakage flux, reducing the efficiency of the effective magnetic flux generated in the gap G.

SUMMARY OF THE INVENTION

An object of the present invention is to provide a method of making a yoke and a plate having accurate dimensions, thereby increasing efficiency of the effective magnetic flux generated in a magnetic gap in the magnetic circuit.

According to the present invention, there is provided a method of making elements of a magnetic circuit of a loudspeaker where each element has accurately dimensioned thin peripheral portion. The element is shaped by forging a workpiece provided between a upper die and a lower die which cooperate to form a circumferential gap, so that by plastic flow, the workpiece expands into the gap, thereby forming a circumferential projection.

More particularly, method of making an element of a magnetic circuit for a loudspeaker comprises the steps of providing a lower die having a first recess corresponding to one of outer shapes of the element, providing an upper die having a second recess, the outer diameter of the upper dies being smaller than the inner diameter of the first recess so that a gap is formed between the inside wall of the first recess and the outside wall of the upper die, putting a workpiece between the lower and upper dies, and pressing the upper die against the lower die to form the element having a circumferential projection caused by the gap.

An element made by the method comprises a central thick portion, a curved portion adjacent the central thick portion, thickness of which reduces to the periphery thereof, and a circumferential projection having a larger thickness than the outermost thickness of the curved portion.

The other objects and features of this invention will become understood from the following description with reference to the accompanying drawings.

DETAILED DESCRIPTION OF THE PREFERRED EMBODIMENT

Figure 1A:
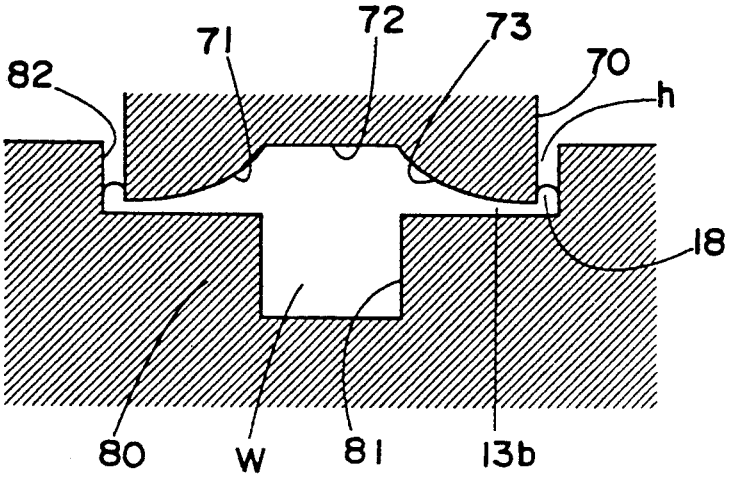
FIG. 1*a* is a sectional view of upper and lower dies for making a yoke in accordance with the method of the present invention.
Figure 1B:
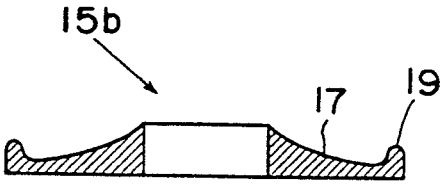
FIG. 1*b* is a sectional view of a plate made by the method of the present invention.
Figure 1C:
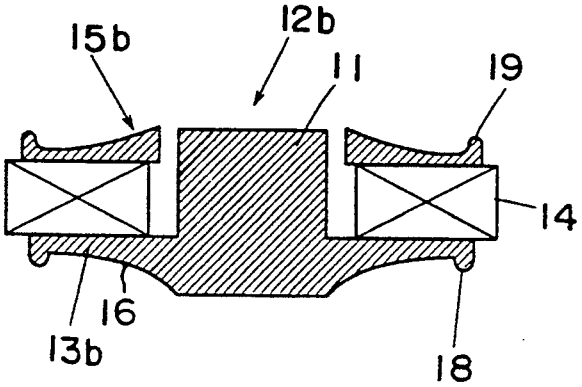
FIG. 1*c* is a sectional view describing a magnet circuit of a loudspeaker composed by the plate and the yoke of FIGS. 1*a* and 1*b;*
Figure 2:
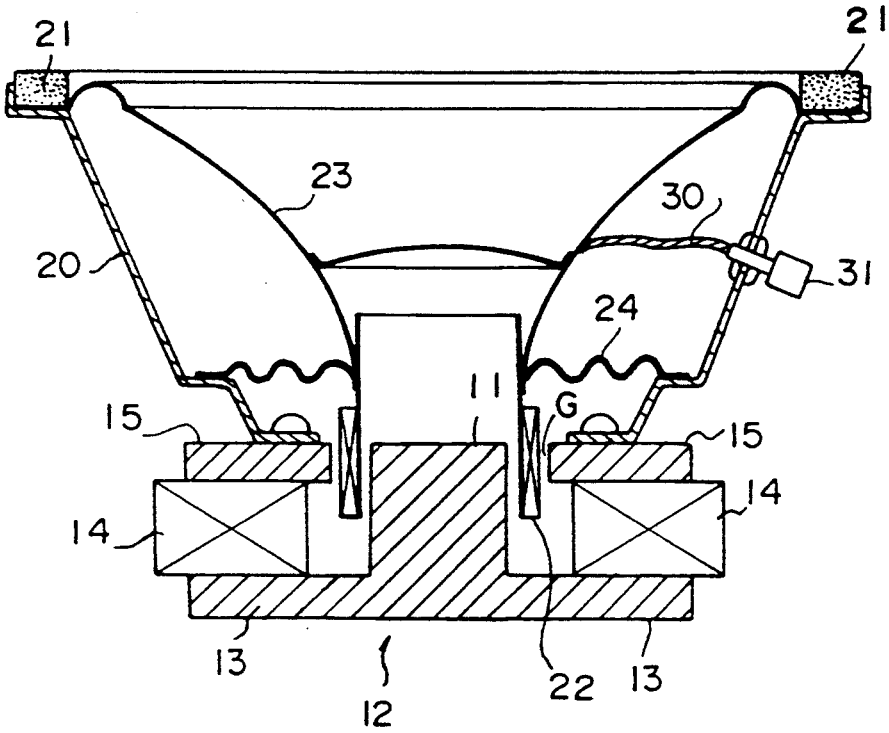
FIG. 2 PRIOR ART
FIG. 2 is a sectional view of a conventional cone loudspeaker.
Figure 3:
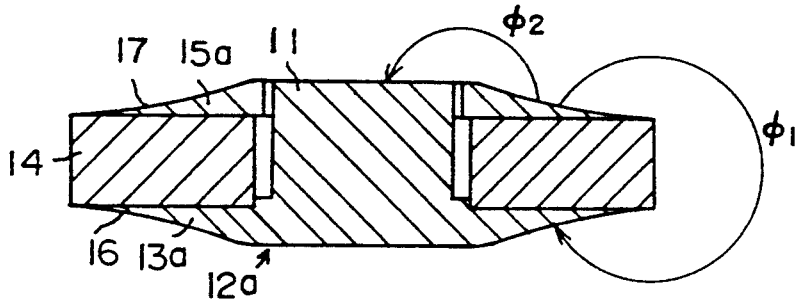
FIG. 3 PRIOR ART
FIG. 3 is a sectional view showing a magnetic circuit for a loudspeaker which has been proposed by the inventors.
Figure 4A:
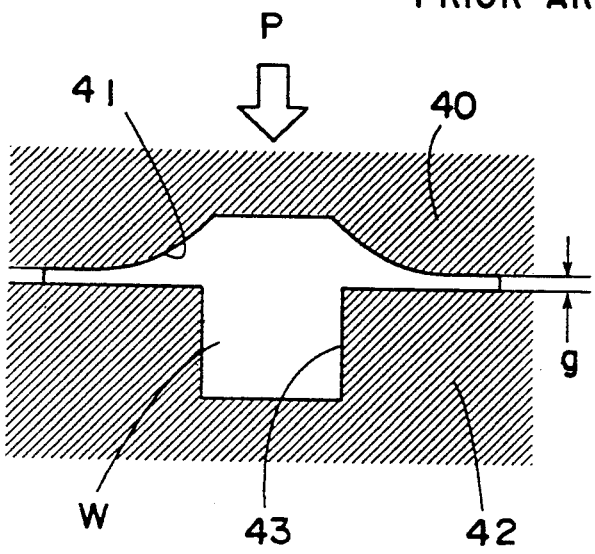
FIG. 4a PRIOR ART
FIG. 4*a* is a sectional view of dies for making a yoke of a loudspeaker by a conventional dies.
Figure 4B:
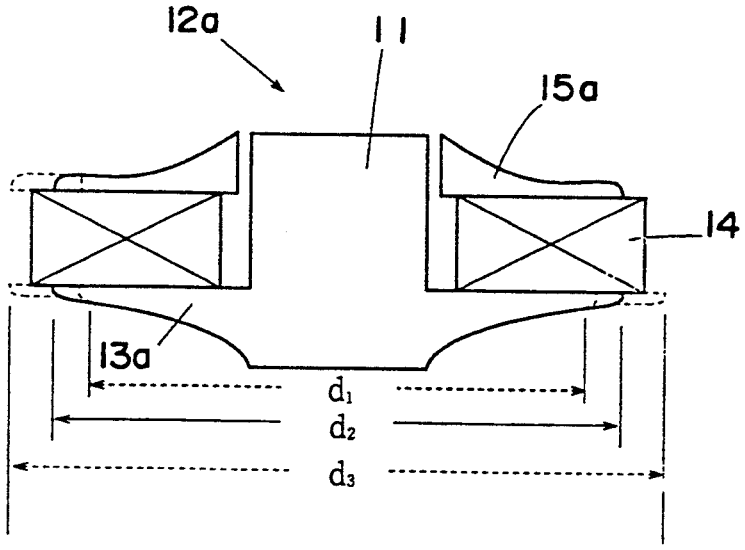
FIG. 4b PRIOR ART
FIG. 4*b* is a sectional view for describing problems which occur in a magnetic circuit generated by the yoke made of FIG. 4*a*.

FIG. 1*a* shows upper and lower dies 70 and 80 for making a yoke 12*b* shown in FIG. 1*c* by cold forging. The upper die 70 has a recess 71 for a desired shape of the lower portion of the yoke 12*b*. The recess 71 has a center flat portion 12 and a downward curve 73 which corresponds to the curve 16 of the yoke 12*b*. The lower die 80 has a circular large shallow recess 82, the diameter of which corresponds to the desired diameter of the yoke 12*b*, and a small deep recess 81 formed in a central bottom portion of the recess 82. The shape of the recess 81 corresponds to that of the center pole 11 of the yoke 12*b*. The outer diameter of the upper die 70 is slightly smaller than the inner diameter of the recess 81 so that a gap h is formed between the periphery of the lower die 80 and an outer periphery of the upper die 70.

In order to produce the yoke 12*b*, a workpiece W is disposed in a space between the upper and lower dies 70 and 80. The upper die 70 is pressed against the lower die 80 for forging the workpiece W into a shape of the yoke 12*b*. In accordance with the curve 71 of the upper die, the thickness of the yoke base 13*b* decreases toward the peripheral portion thereof, thereby forming the curve 16. The workpiece W radially expands until it reaches the inner wall of the recess 82. As the workpiece W further expands in the gap h between the upper and lower dies 70 and 80, a circumferential projection 18 is formed on the yoke base 13*b*. Accordingly, the outer diameter of the yoke base 13*b* exactly coincides with that of the diameter of the recess 82, so that the yoke 12*b* is improved in dimensional accuracy. Moreover, since the yoke base 13*b* has a sufficient thickness even at the circumference, reduction in magnetic characteristics can be prevented.

A plate 15*b* having a circumferential projection 19, shown in FIG. 1*b* is made by a similar method to the yoke. Hence the plate 15*b* can be accurately manufactured.

Referring to FIG. 1*c*, the plate 15*b*, yoke 12*b* and the magnet 14 are assembled into a magnetic circuit for a loudspeaker. Since the yoke 12*b* and plate 15*b* are accurately manufactured, the plate 15*b* and, the yoke 12*b* and the magnet 14 can be assembled in a predetermined disposition. Thus the leakage flux is restrained as intended and further more, the appearance of the product is improved.

EXAMPLE

In an example of the present invention, the outer diameter of the die 70 was 55 mm, the diameter of the flat portion 72 of the recess of the upper die 70 was 24 mm and a radius of curvature of the curve 73 was 59 mm. On the other hand, the deep recess 81 of the lower die 80 had a diameter of 20 mm and a depth of 14 mm, and the shallow recess 82 had a diameter of 58 mm and a depth of 5 mm. Accordingly, the annular gap h having a width of 1.5 mm was formed around the upper die 70.

A workpiece W to be disposed between the dies 70 and 80 had a large diameter portion, the height and the diameter of which were 10 mm and 30 mm, respectively, and a small diameter portion, the height and the diameter of which were 14 mm and 19.5 mm, respectively. The upper die 70 was pressed against the lower die 80 at the pressure of 25 kg/mm$^2$ to forge the workpiece W into the yoke 12*b*.

The yoke 12*b* thus obtained had dimensions and dimensional accuracies as shown in the following table. The dimensional accuracy in the table is a standard deviation of fifty yokes 12*b*. The yoke of the comparative example was produced by forging using upper and lower dies which did not form a gap therebetween.

TABLE

| Measuring Points | Present Invention | Comparative Example |
|---|---|---|
| Yoke Base | | |
| Diameter (mm) | 58 | 58 |
| Dimensional Accuracy (%) | 0.86 | 9.0 |
| Peripheral Portion of Yoke Base | | |
| Thickness (mm) | 1.5 | 1.5 |
| Dimensional Accuracy (%) | 5 | 13 |
| Circumferential Projection of Yoke Base | | |
| Height (mm) | 2.0 | None |
| Width (mm) | 1.5 | None |

As evident from the table, the yoke made in accordance with the method of the present invention has excellent dimensional accuracy. Since the circumferential projection is relatively small, it does not serve as a starting point of leakage flux. Thus, when the yoke and plates are assembled as shown in FIG. 1*c*, the thin peripheral portion formed along the circumference of the yoke base sufficiently improves the characteristic of the magnetic circuit.

From the foregoing, it will be understood that the present invention provides a method of making accurately dimensioned elements for a magnetic circuit of a loudspeaker. Therefore, a leakage flux which causes the decrease in the efficiency of effective magnetic flux is restrained.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A method of making an annular plate and a yoke forming a magnetic circuit of a loudspeaker, said method comprising the steps of:

providing a lower die having a first recess corresponding to one of outer shapes of the element;

providing an upper die having a second recess, the outer diameter of the upper die being smaller than the inner diameter of the first recess so that a gap is formed between the inside wall of the first recess and the outside wall of the upper die;

putting a workpiece between the lower and upper dies; and pressing the upper die against the lower die to form the annular plate and the yoke having a circumferential projection caused by the gap.

2. An annular plate for a magnetic circuit of a loudspeaker, said annular plate comprising:

a central thick portion;

a curved portion adjacent the central thick portion, thickness of which reduces to the periphery thereof; and a circumferential projection having a larger thickness than the outermost thickness of the curved portion.

* * * * *